United States Patent [19]

Tedoradze et al.

[11] 4,334,967

[45] Jun. 15, 1982

[54] METHOD FOR PREPARING 1,2-DICHLOROETHANE

[76] Inventors: Gurami A. Tedoradze, proezd Shokalskogo, 67, korpus 2, kv. 268, Moscow; Valentina A. Paprotskaya, mikroraion Serebryanka, 3, kv. 90, Moskovskaya oblast, Pushkino; Andrei P. Tomilov, 5 Parkovaya ulitsa, 56, korpus 6, kv. 59, Moscow; Evegnia A. Ponomarenko, shosse Entuziastov, 100, kv. 148, Moscow; Jury M. Sokolov, Okruzhnoi proezd, 33, korpus 1, kv. 72, Moscow, all of U.S.S.R.

[21] Appl. No.: 252,976

[22] PCT Filed: Jan. 23, 1979

[86] PCT No.: PCT/SU79/00001

§ 371 Date: Sep. 23, 1980

§ 102(e) Date: Jun. 4, 1980

[87] PCT Pub. No.: WO80/01686

PCT Pub. Date: Aug. 21, 1980

[51] Int. Cl.[3] ..... C25B 3/06

[52] U.S. Cl. ..... 204/81

[58] Field of Search ..... 204/81

[56] References Cited

U.S. PATENT DOCUMENTS 4,162,948 7/1979 Yagii et al. ..... 204/81

*Primary Examiner*—R. L. Andrews

*Attorney, Agent, or Firm*—Burgess, Ryan & Wayne

[57] ABSTRACT

A method for preparing 1,2-dichloroethane which comprises electrolysis of a 12–36% aqueous solution of hydrochloric acid having temperature of from 45° to 70° C. simultaneously with supplying ethylene into the anodic space. Prior to the electrolysis, into the aqueous solution of hydrochloric acid, an additive is introduced which comprises a metal of the group of iron, or a compound of a metal of said group, or an alloy containing at least one metal of the group of iron, or any mixtures of the above-mentioned substances; the additive is introduced in such an amount that the concentration of ion of the iron group metals in the aqueous solution of hydrochloric acid is equal to at least 0.006 g-ion per liter of said solution.

1,2-Dichloroethane may be used as a solvent. Furthermore, 1,2-dichloroethane is useful in the production of vinyl chloride which is an important starting monomer for the manufacture of polymers.

5 Claims, No Drawings

METHOD FOR PREPARING 1,2-DICHLOROETHANE

FIELD OF THE INVENTION

The present invention relates to the preparation of chlorine-containing organic compounds and, more particularly, to methods for preparing 1,2-dichloroethane.

STATE OF THE ART

Known in the art is a chemical method for preparing 1,2-dichloroethane by chlorination of ethylene. The process is carried out in a medium of anhydrous 1,2-dichloroethane saturated with ferric chloride at the temperature of 50° C. The yield of 1,2-dichloroethane is approaching 100% as calculated for the reacted chlorine (cf. Japanese Patent No. 48-7083, Cl. C 07 c).

This method necessitates a preliminary production of chlorine, a subsequent purification thereof, compression and a thorough drying. Traces of moisture impair the process parameters by inactivating ferric chloride which is an inhibitor of the substitutive chlorination.

Also known in the art is a method for preparing 1,2-dichloroethane by way of electrolysis of a 4.4–20% aqueous solution of hydrochloric acid having a temperature within the range of from 20° to 70° C. with the simultaneous supply of ethylene into the anodic space. By the term anodic space, which is generally accepted, the space is meant surrounding the anode and occupying not more than 1–2% of the anode height. Ethylene is supplied at such a rate that the amount of hydrochloric acid fed into the solution is 10 times higher than its stoichiometric amount. The electrolysis is carried out in an electrolyzer of the membrane type at an anodic current density of from 0.07 to 0.35 A/cm$^2$. The current yield of 1,2-dichloroethane (which is equivalent to the yield calculated for the reacted chlorine in the chemical method) is 20 to 44%. The rest of the current is consumed mainly for the formation of epichlorohydrin. The yield of 1,2-dichloroethane as calculated for the passed ethylene does not exceed 10% (cf. I. A. Kalinin, V. V. Stender "Electrolytic Oxidation and Chlorination of Ethylene", Journal of Applied Chemistry, vol. 19, No. 10–11, 1946, p. 1045).

This prior art method has a low yield of 1,2-dichloroethane and insufficient purity thereof. The low anodic current density as employed in the process results in a reduced efficiency of the electrolyzer operation. On the other hand, increasing the anodic current density results in the appearance of chlorine in the gases effluent from the electrolyzer which is intolerable due to the formation of an explosive mixture. Carrying-out the process in a membrane-type electrolyzer causes additional losses of electric power due to the voltage drop on the membrane and complicates the process technology and equipment.

DISCLOSURE OF THE INVENTION

The present invention is directed to the provision, in the process of preparing 1,2-dichloroethane by electrolysis of an aqueous solution of hydrochloric acid, of such conditions of the electrolytic process which would make it possible to produce 1,2-dichloroethane with a a high yield (both current yield and yield as calculated for the passed ethylene) and a high purity, as well as to make use of higher anodic current density values and simplify the technology and equipment of the electrolysis.

This object is accomplished by a method of preparing 1,2-dichloroethane by electrolysis of a 12–36% aqueous solution of hydrochloric acid at a temperature within the range of from 45° to 70° C. with a simultaneous admission of ethylene into the anodic space, wherein, in accordance with the present invention, prior to electrolysis, an additive is introduced into the aqueous solution of hydrochloric acid; this additive comprises a metal belonging to the group of iron or a compound of a metal of this group, or an alloy containing at least one metal of the iron group or any combinations of the above-mentioned substances; the additive is introduced in such an amount that the concentration of ions of the metal of the group of iron in the aqueous solution of hydrochloric acid be at least equal to 0.006 g-ion per liter of said solution.

It is generally accepted that the metals of the group of iron are iron, cobalt and nickel.

In the case, where, as the additive according to the present invention, use is made of nickel or cobalt, or compounds of these metals or alloys based thereon or any mixtures of the above-mentioned substances, or a mixture of at least one of the above-mentioned substances with at least one of the following substances: iron, a compound of iron or an iron-based alloy it is advisable that the additive be introduced into the aqueous solution of hydrochloric acid in such an amount that the concentration of ions of said metals is equal to 0.02–0.08 g-ion per liter of said solution.

In the case, where as the additive according to the present invention, use is made of iron or a compound of iron, or alloys based thereon, or any mixtures of the above-mentioned substances, the additive should be introduced in such an amount that the concentration of iron ions is equal to 0.03–0.4 g-ion per liter of said solution.

The method according to the present invention stipulates carrying out the process of electrolysis in a membrane-type electrolyzer and in a membraneless electrolyzer as well.

Carrying out the process in a membraneless electrolyzer makes it possible to simplify the process technology and equipment and eliminate losses of electric power caused by the drop of voltage on the membrane.

In the method according to the present invention, as compared to the prior art chemical method, there is no need for the separate preparation of chlorine, compression thereof, thorough drying and transportation. All stages of the method according to the present invention are combined and effected in a single reactor (electrolyzer).

The method according to the present invention, as compared to the prior art electrochemical method, makes it possible to substantially increase the current yield of 1,2-dichloroethane (which is equivalent to the yield calculated for the reacted chlorine in the chemical method). Thus, the current yield of 1,2-dichloroethane is as high as 98–99%. The yield of 1,2-dichloroethane as calculated for the passed ethylene is as high as 95–98%. The thus-prepared products are characterized by high purity.

Owing to the introduction of the above-mentioned additives into the aqueous solution of hydrochloric acid, it is possible to considerably increase the permissible anodic current density values (up to 1.3 A/cm$^2$) as compared to the prior art electrochemical method (the term permissible current density means such current density at which chlorine is absent in the effluent gases from the electrolyzer). An increase of the permissible anodic current density is observed already upon the introduction of such an amount of the additive at which the concentration of ions of metals belonging to the group of iron in the aqueous solution of hydrochloric acid is equal to 0.006 g-ion per liter of the solution. Increased anodic current density makes it possible to improve the efficiency of operation of the electrolyzer. However, it is known that with increasing anodic current densities, operation costs are also increased mainly due to losses of electric power for Joule heat. An optimal anodic current density exists for every electrolyzer at which density losses of electric power are minimal. This optimal anodic current density for a 12–36% aqueous solution of hydrochloric acid is a current density of from 0.4 to 1.0 A/cm$^2$ which is provided in the method according to the present invention.

When the additives according to the present invention are not present in a solution of hydrochloric acid, as in the prior art electrochemical method, anodic current density does not exceed 0.35 A/cm$^2$. Increasing anodic current density causes the appearance of chlorine in the off-gases which is intolerable due to the formation of an explosive mixture of chlorine with hydrogen evolved at the cathode and the excessive ethylene.

THE PREFERRED EMBODIMENT OF THE INVENTION

The method according to the present invention makes it possible to use, as the electrolyte, a 12–36% aqueous solution of hydrochloric acid of any grade which has not been subjected to stripping and comprising a waste product resulting from the production of chlororganic compounds.

As the compounds of nickel, cobalt and iron in the method of the present invention, use may be made of, for example, salts of sulphuric acid and hydrochloric acids such as: $FeSO_4(NH_4)_2$ $SO_4.6H_2O$; $NiSO_4.7H_2O$, $CoSO_4.7H_2O$; $FeCl_3.6H_2O$; $NiCl_2.6H_2O$; $CoCl_2.6H_2O$; lower hydroxides of these metals; ferric hydroxide; oxides such as CoO, NiO, $Fe_2O_3$; sulphides such as FeS.NiS; FeS; CoS, NiS; siderite $FeCO_3$ and the like.

As the alloys containing metals of the group of iron, use may be made of alloys having different compositions, for example, the following alloys (percent by weight):

| Fe | Co | Ni | Al | Mn | Cu | Cr | Si |
|---|---|---|---|---|---|---|---|
| 21.5 | — | 78.5 | — | — | — | — | — |
| 30 | — | — | — | 70 | — | — | — |
| 60 | — | — | — | 40 | — | — | — |
| 93.43 | — | 3.75 | — | 0.6 | — | 1.85 | 0.37 |
| 52 | — | 48 | — | — | — | — | — |
| 64 | — | 36 | — | — | — | — | — |
| 52 | — | 36 | — | — | — | 12 | — |
| 67 | — | 22 | 11 | — | — | — | — |
| 52 | — | 34 | 14 | — | — | — | — |
| 50 | 24 | 14 | 9 | — | 3 | — | — |

The metals of the group of iron, compounds of said metals or alloys based thereon, may be used both separately and in various combinations.

The process of electrolysis according to the present invention may be performed both in a membrane-type electrolyzer and in a membrane-free electrolyzer. Electrodes may be made of any material resistant against a concentrated hydrochloric acid under the conditions of electrolysis, e.g., graphite or platinum.

The method according to the present invention is preferably embodied in the following manner.

A 12–36% aqueous solution of hydrochloric acid is poured into an electrolyzer. Thereafter, an additive, i.e., a metal of the group of iron (iron, cobalt or nickel), or a compound of a metal of this group, or an alloy containing at least one of the metals of this group, or any mixtures of the above-mentioned substances, are introduced into the electrolyzer. The additive is introduced either in the solid form, or in the form of a solution in water or in an inorganic acid (the latter is more preferable) in such an amount that the concentration of ions of metals of the group of iron in the aqueous solution of hydrochloric acid is equal to at least 0.006 g-ion per one liter of this solution. Thereafter, into the anodic space, a current of ethylene is passed and the contents of the electrolyzer are intermixed for 1–2 minutes. The solution temperature in the electrolyzer is brought to 45°–70° C. Then the voltage of direct current is applied to the electrolyzer and the current is controlled so that the anodic current density would be up to 1.3 A/cm$^2$, preferably within the range of from 0.4 to 1.0 A/cm$^2$. The supply rate of ethylene is controlled so that the amount of ethylene supplied to the anodic space is 2–5% higher than its stoichiometric amount. In the case where solution temperature in the electrolyzer rises above 70° C., a cooling system is switched on to maintain the solution temperature within the range of from 45° to 70° C. During electrolysis, hydrogen and chlorine are formed. Chlorine reacts with ethylene according to the scheme:

$$C_2H_4+2Cl_{ads}\rightarrow C_2H_4Cl_2$$

wherein $Cl_{ads}$ means elemental chlorine absorbed on the anode.

The effluent gases from the electrolyzer comprising a mixture of hydrogen, excessive ethylene and 1,2-dichloroethane are passed, along with vapours of the hydrochloric acid solution, to a reflux condenser, wherein the vapours of the solution of hydrochloric acid are condensed. The condensed solution of hydrochloric acid is recycled to the electrolyzer. The gases containing 1,2-dichloroethane are fed to a cooling unit, wherein 1,2-dichloroethane is condensed. The off-gases from the cooling unit are passed through an aqueous solution of potassium iodide serving as an indicator for the presence of chlorine and then subjected to compression.

For a better understanding of the present invention, some specific Examples illustrating its embodiment are given hereinbelow. In all the Examples, chlorine is not present in the effluent gases from the electrolyzer.

EXAMPLE 1

Into an electrolyzer provided with a membrane made of a polyemric material "Nafion" (available from "DuPont", an American Company), a graphite anode and a platinum cathode 800 ml of a 27% aqueous solution of a commercial hydrochloric acid are charged and ferric chloride is added in the form of an aqueous solution thereof in such an amount that the concentration of ferric ions in the aqueous solution of hydrochloric acid is equal to 0.1 g-ion per one liter of the solution. The solution temperature is raised to 50° C. Thereafter, ethylene is passed into the anodic space of the electrolyzer at such a rate that the amount of the ethylene supplied is 5% higher as compared to its stoichiometric amount. The electrolysis is conducted at the current of 56 A and anodic current density of 0.7 A/cm$^2$ for one hour.

The current yield of 1,2-dichloroethane is equal to 98%; the yield as calculated for the passed ethylene is 93%. Purity of the resulting 1,2-dichloroethane is 97.5%. Impurities comprise 1,1,2-trichloroethane (1.2%, ethylenechlorohydrin 0.8% and 0.5% $\beta,\beta'$-dichlorodiethyl ether (chlorex) in the amount of.

EXAMPLE 2

A stream of a 20% aqueous solution of hydrochloric acid is passed through a membraneless flow-type electrolyzer with a platinum anode and cathode at such a rate that the solution of hydrochloric acid effluent from the electrolyzer has the concentration of 18%. Prior to the supply of the solution of hydrochloric acid into the electrolyzer, ferric chloride is added thereto in such an amount that after its dissolution, the concentration of ferric ions in the solution is equal to 0.03 g-ion per one liter of the solution. The temperature of the aqueous solution of hydrochloric acid in the electrolyzer is 55° C. Into the anodic space, ethylene is passed at such a rate that the amount of the passed ethylene is 3% higher than its stoichiometric amount. The electrolysis is conducted at the current of 56 A and anodic current density of 0.4 A/cm$^2$ for one hour.

The current yield of 1,2-dichloroethane is 98%; the yield of the product as calculated for the passed ethylene is 95%. The purity of the resulting 1,2-dichloroethane is 96.3%. The impurities comprise 1,1,2-trichloroethane (3.3%) and chlorex (0.4%).

EXAMPLE 3

The process is conducted as described in the foregoing Example 2, except that use is made of graphite electrodes and electrolysis is conducted at the anodic current density of 0.5 A/cm$^2$.

The current yield of 1,2-dichloroethane is 88%; the yield calculated for the passed ethylene is equal to 85%. The impurities are 1,1,2-trichloroethane (1.2%), ethylenechlorohydrin (2.8%) and chlorex (0.5%).

EXAMPLE 4

The process is conducted as in Example 2 hereinbefore, except that use is made of graphite electrodes and the starting concentration of the aqueous solution of hydrochloric acid is 12%.

The current yield of 1,2-dichloroethane is 88%; the yield calculated for the passed ethylene is 83%. The impurities are 1,1,2-trichloroethane (0.9%) and ethylenechlorohydrin (3.6%).

EXAMPLE 5

The process is conducted as in Example 2 hereinbefore, except that the starting concentration of the aqueous solution of hydrochloric acid is 18% and the final concentration-to 17%.

The results obtained are the same as in Example 2.

EXAMPLE 6

The process is conducted as in Example 2, except that the concentration of ferric ions in the aqueous solution of hydrochloric acid is 0.01 g-ion The results obtained are the same as in Example 2.

EXAMPLE 7

The process is carried out following the procedure of Example 2, except that the concentration of iron ions in the aqueous solution of hydrochloric acid is 0.3 g-ion per one liter of the solution.

The current yield of 1,2-dichloroethane is 91%; the yield of the product as calculated for the passed ethylene is 88%. The impurities are 1,1,2-trichloroethane (1,6%), ethylenechlorohydrin 0.8%) and chlorex (0.4%).

EXAMPLE 8

Into a membrane-free electrolyzer with a graphite anode and cathode there are poured 800 ml of a 27% aqueous solution of commercial hydrochloric acid and pieces of siderite $FeCO_3$ are added thereto so as to ensure, after its dissolution, that, the concentration of iron ions in the solution is 0.4 g-ion per one liter of the solution. The temperature of the aqueous solution of hydrochloric acid in the electrolyzer is 50° C. Into the anodic space, ethylene is passed at such a rate that the amount of the passed ethylene is 5% higher than its stoichiometric amount. Electrolysis is conducted at the current of 56A and anodic current density of 0.7 A/cm$^2$ for one hour.

The current yield of 1,2-dichloroethane is 85%; the yield as calculated for the passed ethylene is equal to 80%. The impurities comprise 1,1,2-trichloroethane (1.1%) ethylenechlorohydrin (0.7%) and chlorex (0.5%).

EXAMPLE 9

The process is conducted as in Example 8, but prior to the supply of the solution of hydrochloric acid to the electrolyzer, an alloy of iron is added to the latter in the form of chips having the following composition, percent by weight: Fe—93.43; Si—0.37; Mn—0.6; Cr—1.85; Ni—3.75. The alloy is added to the solution in such an amount that after its dissolution, the concentration of iron ions in the solution is 0.4 g-ion per one liter of the solution.

The results obtained are the same as in Example 8.

EXAMPLE 10

The process is carried out as in Example 8, except that prior to the supply of the solution of hydrochloric acid to the electrolyzer, lumps of metallic iron are added thereto in such an amount that after its dissolution, the concentration of iron ions in the solution is 0.4 g-ion per one liter of the solution.

The results obtained are the same as in Example 8.

EXAMPLE 11

The process is carried out as in Example 8 hereinbefore, except that instead of siderite $FeCO_3$, use is made of ferric hydroxide $Fe(OH)_3$.

The results obtained are as in Example 8 hereinbefore.

EXAMPLE 12

The process is carried out as in Example 8, except that instead siderite $FeCO_3$, use is made of ferrous hydroxide $Fe(OH)_2$.

The results obtained are the same as in Example 8.

EXAMPLE 13

The process is carried out as in Example 8 hereinbefore, except that instead of siderite $FeCO_3$, use is made of ferric oxide $Fe_2O_3$.

The obtained results are the same as in Example 8.

EXAMPLE 14

The process is carried out as in Example 8, except that instead of siderite $FeCO_3$, use is made of ferric sulphate $Fe_2(SO_4)_3$.

The results obtained are the same as in Example 8.

EXAMPLE 15

The process is conducted as in the foregoing Example 8, except that as the additive, use is made of an iron alloy of the following composition, percent by weight: Fe—30; Mn—70.

The results obtained are the same as in Example 8.

EXAMPLE 16

The process is conducted as in Example 8, except that as the additive, use is made of an iron alloy of the following composition, percent by weight: Fe—60; Mn—40.

The results obtained are the same as in Example 8.

EXAMPLE 17

Into a membrane-free electrolyzer with a graphite anode and cathode, there are charged 800 ml of a 27% aqueous solution of hydrochloric acid and ferric chloride is added thereto in such an amount that the concentration of ferric ions in the solution of hydrochloric acid is 0.06 g-ion per one liter of the solution. The solution temperature is raised to 45° C. Thereafter, ethylene is passed into the anodic space at such a rate the amount of the supplied ethylene is 5% higher than its stoichiometric amount. The electrolysis is conducted at the current of 56 A and anodic current density of 0.7 $A/cm^2$ for one hour.

The current yield of 1,2-dichloroethane is equal to 89%; the yield of the product as calculated for the passed ethylene is 84%. The impurities are 1,1,2-trichloroethane (0.8%) and chlorex (0.2%).

EXAMPLE 18

The process is conducted as in the foregoing Example 17, except that the temperature of the solution of hydrochloric acid is maintained at 60° C.

The current yield of 1,2-dichloroethane is equal to 92%; the yield of the product as calculated for the passed ethylene is 87%. The impurities are 1,1,2-trichloroethane (1.5%) and chlorex (0.2%).

EXAMPLE 19

The process is carried out as in Example 17 hereinbefore, except that the temperature of the aqueous solution of hydrochloric acid is maintained at 70° C. The current yield of 1,2-dichloroethane is 83%; the yield of the product as calculated for the passed ethylene is 78%. The impurities are 1,1,2-trichloroethane (12.8) and chlorex (0.2%).

EXAMPLE 20

Into a membraneless electrolyzer with a graphite anode and cathode there are poured 800 ml of a 27% aqueous solution of hydrochloric acid and ferric chloride is added in such an amount that the concentration of ferric ions in the aqueous solution of hydrochloric acid 0.4 g-ion per one liter of the solution. The solution temperature is elevated to 55° C. Afterwards, ethylene is passed into the anodic space at such a rate that the amount of the supplied ethylene is 4% higher as compared to its stoichiometric amount. The electrolysis is conducted at the current of 112 A and anodic current density of 0.9 $A/cm^2$ for 0.5 hour.

The current yield of 1,2-dichloroethane is equal to 95%; the product yield as calculated for the passed ethylene is 91%. The impurities are 1,1,2-trichloroethane (2.5%) and chlorex (0.6%).

EXAMPLE 21

The process is conducted following the procedure described in Example 1 hereinbefore, except that the concentration of ferric ions in the aqueous solution of hydrochloric acid is 0.6 g-ion per one liter of the solution and the anodic current density is 1.2 $A/cm^2$.

The current yield of 1,2-dichloroethane is 97%; the yield as calculated for the passed ethylene is 92%. The impurities are 1,1,2-trichloroethane (3%) and chlorex (1.2%).

EXAMPLE 22

The process is conducted as in Example 17 hereinbefore, except that the use is made of a 36% aqueous solution of hydrochloric acid. The results thus obtained are the same as in Example 17.

EXAMPLE 23

The process is performed in a manner similar to that described in the foregoing Example 7, except that as the additive, use is made of a mixture of metallic iron containing 99.8% by weight of the principal substance with an alloy consisting of 30% by weight of Fe and and 70% by weight of Mn. The ratio between iron and the alloy, expressed in parts by weight, is 1:3 respectively. The additive is introduced into the solution of hydrochloric acid in such an amount that the concentration of iron ions is 0.3 g-ion per one liter of the solution.

The results obtained are the same as in Example 7.

EXAMPLE 24

The process is carried out as in Example 8, except that as the additive, use is made of a mixture of metallic iron containing 99.8% by weight of the principal substance with ferric hydroxide $Fe(OH)_3$. The ratio between the metallic iron and ferric hydroxide, expressed in parts by weight, is equal to 1:2. The additive is introduced into the solution of hydrochloric acid in such an amount that the concentration of ferric ions is 0.4 g-ion per one liter of the solution.

The results obtained are the same as in Example 8.

EXAMPLE 25

The process is conducted following the procedure of Example 17 hereinbefore, except that as the additive, use is made of a mixture of an alloy consisting of 30% by weight of Fe and 70% by weight of Mn with ferric chloride $FeCl_3$. The weight ratio of the alloy with the salt is equal to 1:1. The additive is introduced into the solution of hydrochloric acid in such an amount that the concentration of iron ions is 0.06 g-ion per one liter of the solution.

The results obtained are the same as in Example 17.

EXAMPLE 26

Into a membrane-type electrolyzer with the membrane made of a polymeric material "Nafion" (available from "DuPont", an American company), a graphite anode and a platinum cathode, there are poured 800 ml of a 27% aqueous solution of commercial hydrochloric acid and nickel chloride (preliminary dissolved in a 27% aqueous solution of commercial hydrochloric acid) is added thereto in such an amount that the concentration of nickel ions in the aqueous solution of hydrochloric acid is 0.06 g-ion per one liter of the solution. The solution temperature is elevated to 60° C. Thereafter, ethylene is admitted into the anodic space at such a rate that the amount of the supplied ethylene is 2% higher than its stoichiometric amount. The electrolysis is conducted at the current of 56 A and anodic current density of 0.7 A/cm$^2$ for one hour.

The current yield of 1,2-dichloroethane is 99.6%; the product yield as calculated for the passed ethylene is 98%. The product purity is 99.3%. The impurities are 1,1,2-trichloroethane (0.5%) and tetrachloroethane (0.2%).

EXAMPLE 27

Through a membraneless flow-type electrolyzer provided with platinum anode and cathode, a stream of a 20% aqueous solution of hydrochloric acid is passed at such a rate that the solution of hydrochloric acid effluent from the electrolyzer has the concentration of 18%. Prior to the supply of the solution of hydrochloric acid to the electrolyzer, a mixture of chlorides of nickel and iron, taken in the equimolar amounts, is added to the apparatus so that the total concentration of metal ions in the solution is 0.006 g-ion per one liter of the solution. The temperature of the solution of hydrochloric acid in the electrolyzer is maintained at 55° C. Ethylene is admitted into the anodic space at such a rate that the amount of the supplied ethylene is 3% higher than is stoichiometric amount. The electrolysis is conducted at the current of 56 A and anodic current density of 0.4 A/cm$^2$ for one hour.

The current yield of 1,2-dichloroethane is equal to 99.6%; the product yield as calculated for the passed ethylene is equal to 96.5%. Purity of the resulting 1,2-dichloroethane is equal to 99.5%. Impurities are 1,1,2-trichloroethane (0.3%) and tetrachloroethane (0.2%).

EXAMPLE 28

The process is conducted in a manner similar to that described in the foregoing Example 27, except that use is made of graphite electrodes and the electrolysis is conducted at the anodic current density of 0.5 A/cm$^2$.

The current yield of 1,2-dichloroethane is 99.3%; the yield as calculated for the passed ethylene is 96.4%. The impurities are 1,1,2-trichloroethane 0.5%), and tetrachloroethane (0.2%).

EXAMPLE 29

The process is carried out as in Example 27, except that use is made of graphite electrodes and the starting concentration of the aqueous solution of hydrochloric acid is 15%; the final concentration of the solution is 13%.

The current yield of the resulting 1,2-dichloroethane is 98%; the product yield as calculated for the passed ethylene is equal to 95%. The impurities are 1,1,2-trichloroethane (0.3%) and 1,1,2,2-tetrachloroethane (0.2%).

EXAMPLE 30

The process is carried out in a manner similar to that of Example 27 hereinbefore, except that the starting concentration of the aqueous solution of hydrochloric acid is 18% and the final concentration thereof is 17%. The results obtained are the same as in Example 27.

EXAMPLE 31 (comparative)

Into a membraneless electrolyzer with a graphite anode and cathode, there are poured 900 ml of a 27% aqueous solution of hydrochloric acid, and a mixture of chlorides of nickel and iron, in equimolar amounts, is added thereto in such an amount that the total concentration of metal ions in the solution of hydrochloric acid is 0.002 g-ion per one liter of the solution. Thereafter, ethylene is passed into the anodic space at such a rate that the amount of the supplied ethylene is 5% higher than its stoichiometric amount. The electrolysis is conducted at the temperature of 60° C., current of 56 A and an anodic current density of 0.7 A/cm$^2$ for one hour.

The current yield of the resulting 1,2-dichloroethane is 89.5%; the product yield as calculated for the passed ethylene is 83.7%. The product purity is equal to 99.2%. Evolution of chlorine is observed. The current yield of chlorine is 10.5%.

EXAMPLE 32

Into a membraneless electrolyzer with a graphite anode and cathode, there are poured 900 ml of a 27% aqueous solution of commercial hydrochloric acid and a mixture of chlorides of nickel and iron, in equimolar amounts, is added thereto in such an amount, that the total concentration of ions of these metals in the solution of hydrochloric acid is 0.03 g-ion per one liter of the solution. The solution temperature is elevated to 60° C. and ethylene is admitted into the anodic space at such a rate that the amount of the supplied ethylene 5% higher than its stoichiometric amount. The electrolysis is conducted at the current of 56 A and anodic current density of 0.7 A/cm$^2$ for one hour.

The current yield of 1,2-dichloroethane is equal to 99.5%; the yield as calculated for the passed ethylene is 95%. The purity of the resulting product is 99.3%. No chlorine is evolved.

EXAMPLE 33

Into a membraneless electrolyzer with a graphite anode and cathode, there are charged 900 ml of a 27% aqueous solution of commercial hydrochloric acid and a mixture of chlorides of nickel and iron, in equimolar amounts, is added thereto in such an amount that the total concentration of ions of these metals in the solution of hydrochloric acid be equal to 0.008 g-ion per one liter of the solution. The solution temperature is maintained at 60° C. Ethylene is then admitted into the anodic space at such a rate that the amount of the supplied ethylene is 2% higher as compared to the stoichiometric amount thereof. The electrolysis is conducted at the current of 56 A and anodic current density of 0.7 A/cm$^2$ for one hour.

The current yield of the resulting 1,2-dichloroethane is 99.3%; the yield as calculated for the passed ethylene is equal to 98%. No evolution of chlorine is observed.

EXAMPLE 34

Into a membraneless electrolyzer with a graphite anode and cathode, there are charged 900 ml of a 27% aqueous solution of commercial hydrochloric acid and a mixture of chlorides of nickel and iron, in equimolar amounts, is added thereto in such an amount that the total concentration of ions of these metals in the solution of hydrochloric acid be is 0.02 g-ion per one liter of the solution. The solution temperature is maintained at 60° C. Ethylene is admitted into the anodic space at such a rate that the amount of the supplied ethylene is 2% higher as compared to the stoichiometric amount thereof. The electrolysis is conducted at the current of 56 A and anodic current density of 1 A/cm$^2$ for one hour.

The current yield of 1,2-dichloroethane is equal to 99.6%; the yield of the product as calculated for the passed ethylene is 98%. The product purity is 99.2%. The impurities are 1,1,2-trichloroethane (0.6%) and tetrachloroethane (0.2%). No evolution of chlorine is observed.

EXAMPLE 35

Into a membraneless electrolyzer with a graphite anode and cathode there are charged 900 ml of a 27% aqueous solution of commercial hydrochloric acid and a mixture of chlorides of nickel and iron, in equimolar amounts, is added thereto in such amounts that the total concentration of ions of these metals in the solution of hydrochloric acid is 0.05 g-ion per one liter of the solution. The solution temperature is maintained at 60° C. The electrolysis is conducted with an excessive amount of ethylene which is 2.5% higher as compared to the stoichiometric amount thereof, the current of 56 A and anodic current density of 1 A/cm$^2$, for one hour.

The current yield of the resulting 1,2-dichloroethane is equal to 99%; the yield as calculated for the passed ethylene is 97.5%. The product purity is equal to 99%. The impurities are 1,1,2-trichloroethane (0.6) and tetrachloroethane (0.4%). No evolution of chlorine is observed.

EXAMPLE 36

Into a membraneless electrolyzer provided with a graphite anode and cathode there are poured 1,000 ml of a 36% aqueous solution of commercial hydrochloric acid and a mixture of chlorides of nickel and iron, in equimolar amounts, is added thereto in such an amount that the total concentration of ions of these metals is 0.02 g-ion per one liter of the solution. The solution temperature is maintained at 60° C. The electrolysis is conducted at an excess of ethylene of 3.5% over its stoichiometric amount, the current of 105 A and anodic current density of 1.3 A/cm$^2$, for one hour.

The current yield of the resulting 1,2-dichloroethylene is equal to 99.2%; the yield as calculated for the passed ethylene is 96.5%. The product purity is 99%.

EXAMPLE 37

The process is carried out in a manner similar to that described in the foregoing Example 32, except that as the additive, use is made of nickel chloride in such an amount that the concentration of nickel ions in the aqueous solution of hydrochloric acid is 0.02 g-ion per one liter of the solution.

The current yield of the resulting 1,2-dichloroethane is equal to 99.6%; the yield as calculated for the passed ethylene is 95%. The product purity is equal to 99.1%.

EXAMPLE 38

Into a membrane-free electrolyzer provided with a graphite anode and cathode there are poured 900 ml of a 27% aqueous solution of commercial hydrochloric acid and cobalt chloride is added thereto in such an amount that the concentration of cobalt ions in the solution of hydrochloric acid is 0.02 g-ion per one liter of the solution. The solution temperature is maintained at 60° C. The electrolysis is effected with an excess of ethylene of 2.6% over its stoichiometric amount, the current of 80 A and anodic current density of 1 A/cm$^2$, for one hour.

The current yield of the resulting 1,2-dichloroethane is equal to 99%; the yield as calculated for the passed ethylene is 97.4%. The product purity is equal to 99%. The impurities are 1,1,2-trichloroethane (0.4%) and 1,1,2,2-tetrachloroethane (0.6%).

EXAMPLE 39

The process is carried out as described in Example 27 hereinbefore, except that use is made of graphite electrodes. The total concentration of ions of nickel and iron in the solution of hydrochloric acid is 0.02 g-ion per one liter of the solution.

The current yield of the resulting 1,2-dichloroethane is 99.8%; the yield as calculated for the passed ethylene is equal to 97%. The impurity is 1,1,2-trichloroethane (0.4%).

EXAMPLE 40

The process is conducted following the procedure described in the foregoing Example 36, except that the total concentration of ions of nickel and iron is equal to 0.12 g-ion per one liter of the solution.

The current yield of 1,2-dichloroethane is 98%; the yield as calculated for the passed ethylene is 87.8%. The product purity is equal to 99%. The impurities are 1,1,2-trichloroethane (0.4%) and 1,1,2,2-tetrachloroethane (0.6%).

EXAMPLE 41

The process is carried out as described in Example 36, except that the total concentration of ions of nickel and iron is equal to 0.3 g-ion per one liter of the solution.

The current yield of the resulting 1,2-dichloroethane is 90.2%; the yield as calculated for the passed ethylene is 87.8%. The product purity is 99.2%. The impurities are 1,1;2-trichloroethane (0.4%) and tetrachloroethane (0.4%).

EXAMPLE 42

Into a membraneless electrolyzer with a graphite anode and cathode there are poured 800 ml of a 27% aqueous solution of commercial hydrochloric acid and a mixture of $CoSO_4.7H_2O$ and Mohr's salt $FeSO_4(NH_4)_2SO_4.6H_2O$, in equimolar amounts, is added thereto in such an amount that the total concentration of metal ions in the solution of hydrochloric acid is 0.05 g-ion per one liter of the solution. The solution temperature is maintained within the range of from 50° to 60° C. Into the anodic space, ethylene is passed at such a rate that the amount of the supplied ethylene is 3% higher than its stoichiometric amount. The electrolysis is conducted at the current of 56 A and anodic current density of 0.7 $A/cm^2$, for one hour.

The current yield of the resulting 1,2-dichloroethane is 99.5%; the yield as calculated for the passed ethylene is 97%. The impurities are 1,1,2-trichloroethane (0.5% and tetrachloroethane (0.2%).

EXAMPLE 43

The process is conducted in a manner similar to that described in Example 35 hereinbefore, except that prior to supplying the solution of hydrochloric acid to the electrolyzer, an alloy in the form of chips with the following composition, in percent by weight: Fe—50, Cu—3, Al—9, Co—24, Ni—14, is added thereto. The alloy is introduced into the solution in such an amount, that after its dissolution the total concentration of ions of iron, nickel and cobalt in the solution of hydrochloric acid is 0.05 g-ion per one liter of the solution.

The results obtained are the same as in Example 42.

EXAMPLE 44

The process is conducted in the manner described in Example 42, except that prior to supplying the solution of hydrochloric acid to the electrolyzer, added to the latter are lumps of metallic iron and metallic nickel, in equal amounts, so that after their dissolution, the total concentration of ions of iron and nickel in the solution is 0.05 g-ion per one liter of the solution.

The results obtained are the same as in Example 42.

EXAMPLE 45

The process is carried out as in Example 42 hereinbefore, except that instead of $CoSO_4.7H_2O$ and Mohr's salt, use is made of a mixture of hydroxides of $Fe(OH)_3$ and $Co(OH)_2$, in equimolar amounts.

The results thus obtained are similar to those obtain in Example 42.

EXAMPLE 46

The process is conducted as described in Example 46, except that instead of $CoSO_4.7H_2O$ and Mohr's salt, use is made of lower hydroxides of iron and nickel $Fe(OH)_2$ and $Ni(OH)_2$, in equimolar amounts.

The thus-obtained results are the same as in Example 42.

EXAMPLE 47

The process is carried out as in Example 42, except that as the additive, use is made of a mixture of oxides of $Fe_2O_3$ and NiO, in equimolar amounts.

The results obtained are the same as in Example 42.

EXAMPLE 48

The process is carried out following the procedure described in Example 39, with the only exception that, as the additive, use is made of a mixture of sulphates $Fe_2(SO_4)_3$ and $NiSO_4$, in equimolar amounts.

The thus-obtained results are the same as in Example 42 hereinbefore.

EXAMPLE 49

The process is carried out as in Example 42, but as the additive, use is made of an alloy having the following composition, in percent by weight: Fe—52; Ni—48.

The results are the same as in Example 42.

EXAMPLE 50

The process is carried out as in Example 42, but as the additive, use is made of a alloy having the following composition, in percent by weight: Ni—78,5; Fe—21.5.

The results obtained are similar to those of Example 42 hereinbefore.

EXAMPLE 51

Into a membraneless electrolyzer with a graphite anode and cathode, there are charged 800 l of a 27% aqueous solution of hydrochloric acid and a mixture of chlorides of nickel and iron, in equimolar amounts, is added in such an amount that the total concentration of metal ions in the aqueous solution of hydrochloric acid is 0.04 g-ion per one liter of the solution. The solution temperature is elevated to 45° C. Thereafter, ethylene is admitted into the anodic space at such a rate that the amount of the supplied ethylene is 2% higher than its stoichiometric amount. The electrolysis is conducted at the current of 56 A and anodic current density of 1.0 $A/cm^2$ for one hour.

The current yield of the resulting 1,2-dichloroethane is equal to 99%; the yield as calculated for the passed ethylene is equal to 97.5%. The impurities are 1,1,2-trichloroethane (0.6%) and tetrachloroethane (0.4%).

EXAMPLE 52

The procedure described in the foregoing Example 51 is repeated, but the temperature of the aqueous solution is maintained at 70° C.

The current yield of the resulting 1,2-dichloroethane is 99.2%; the product yield, as calculated for the passed ethylene, is 97.5%. The impurities are 1,1,2-trichloroethane (0.5%) and tetrachloroethane (0.3%).

EXAMPLE 53

Into a membraneless electrolyzer with a graphite anode and cathode, there are poured 800 ml of a 27% aqueous solution of hydrochloric acid and a mixture of chlorides of iron and nickel in equimolar amounts, is added thereto in such an amount that the total concentration of ions of these metals in the aqueous solution of hydrochloric acid is 0.08 g-ion per one liter of the solution. The solution temperature is elevated to 55° C. Thereafter, ethylene is admitted into the anodic space at such a rate that the amount of the supplied ethylene is 4% higher as compared to the stoichiometric amount thereof. The electrolysis is conducted at the current of 300 A and anodic current density of 1.3 $A/cm^2$ over a 0.5 hour period.

EXAMPLE 54

The process is conducted as described in the foregoing Example 53, except that the total concentration of ions of iron and nickel in the aqueous solution of hydrochloric acid is 0.12 g-ion per one liter of the solution.

The current yield of the resulting 1,2-dichloroethane is 99%; the product yield as calculated for the passed ethylene is equal to 96%. The impurities are 1,1,2-trichloroethane (0.3%) and tetrachloroethane (0.2%).

EXAMPLE 55

The process is carried out as described in Example 35, but as the additive, use is made of a mixture of an alloy consisting of 49% by weight of Ni, 26% by weight of Co and 25% by weight of aluminium with an alloy consisting of 73% by weight of Ni, 11% by weight of Fe and 16% by weight of Cu. The ratio between the alloys in the mixture, expressed in parts by weight is 3:5 respectively. The additive is introduced into the solution of hydrochloric acid in such an amount that the total concentration of ions of these metals of the group of iron is 0.05 g-ion per one liter of the solution.

The results obtained are the same as in Example 35.

EXAMPLE 56

The process is carried out as in Example 51, except that as the additive, use is made of a mixture of metallic nickel, containing 99,8% by weight of the principal product, with the cobalt salt $CoSO_4.7H_2O$. The ratio between metallic nickel and the salt of cobalt, expressed in parts by weight, is 1:4, respectively. The additive is introduced into the solution of hydrochloric acid in such an amount that the total concentration of ions of metals of the group of iron is 0.05 g-ion per 1 liter of the solution.

The results obtained are the same as in Example 51.

EXAMPLE 57

The process is carried out as in Example 51, except that as the additive, use is made of metallic nickel containing 99.8% by weight of the main product with an alloy consisting of 49% by weight of Ni, 26% by weight of Co, and 25% by weight of Al. The ratio between nickel and the alloy, expressed in parts by weight, is 1:2, respectively. The additive is incorporated into the solution of hydrochloric acid in such an amount that the total concentration of ions of the iron group metals is 0.05 g-ion per one liter of the solution.

The results are the same as in Example 51.

EXAMPLE 58

The process is conducted as in Example 51 hereinbefore, except that as the additive, use is made of a mixture of an alloy consisting of 49% by weight of Ni, 26% by weight of Co, 25% by weight of Al with a salt of cobalt $CoSO_4.7H_20$. The ratio between the alloy with the salt of cobalt, expressed in parts by weight, is 1:3 respectively. The additive is introduced into the solution of hydrochloric acid in such an amount that the total concentration of ions of the iron group metals is 0.05 g-ion per one liter of the solution.

The results obtained are the same as in Example 51.

EXAMPLE 59

The process is conducted as in Example 36, except that as the additive, use is made of metallic nickel containing 99.8% by weight of the main substance in such an amount that the concentration of ions of nickel is 0.08 g-ion per one liter of the solution.

The results obtained are the same as in Example 36.

EXAMPLE 60

The process is conducted as in Example 36, except that as the additive, use is made of metallic cobalt containing 99.6% by weight of the principal substance. The additive is introduced into the solution of hydrochloric acid in such an amount that the concentration of cobalt ions is 0.08 g-ion per one liter of the solution.

The results obtained are the same as in Example 36.

EXAMPLE 61

The process is conducted as described in Example 36, but as the additive, use is made of a mixture consisting of 30% by weight of metallic cobalt and 70% by weight of metallic nickel. The additive is introduced into the aqueous solution of hydrochloric acid in such an amount that the total concentration of ions of metals is 0.08 g-ion per one liter of the solution.

The results obtained are the same as in Example 36.

EXAMPLE 62

The process is carried out following the procedure of Example 36, except that as the additive, use is made of a mixture of metallic cobalt and metallic nickel in the amount of 70% by weight, and 30% by weight respectively. The additive is introduced into the aqueous solution of hydrochloric acid in such a rate that the total concentration of ions of the metals is 0.08 g-ion per one liter of the solution.

The results obtained are the same as in Example 36.

EXAMPLE 63

The process is conducted as in Example 48, except that as the additive, use is made of a mixture of metallic nickel, cobalt and iron taken in a weight ratio of 1:1, 5:2.5, respectively. The additive is introduced into the aqueous solution of hydrochloric acid in such an amount that the total concentration of the iron group metals is 0.04 g-ion per one liter of the solution.

The results obtained are the same as in Example 48.

EXAMPLE 64

The process is carried out as described in Example 40, except that as the additive use is made of a mixture of $Ni(OH)_2+CoCl_2+Fe_2O_3$ taken in a weight ratio of 1:1, 5:2.5, respectively. The additive is introduced into the aqueous solution of hydrochloric acid in such an amount that the total concentration of ions of the iron group metals is 0.05 g-ion per one liter of the solution.

The results obtained are the same as in Example 40.

EXAMPLE 65

The process is conducted following the procedure of the foregoing Example 58, except that as the additive, use is made of a mixture of metallic nickel with $CoSO_4.7H_2O$ and an alloy consisting of 70% by weight of iron and 30% by weight of manganese. The weight ratio between the mixture components is 1.5:2:1.5, respectively. The additive is introduced into the aqueous solution of hydrochloric acid in such an amount that the total concentration of ions of metals of the group of iron is 0.08 g-ion per one liter of the solution.

The results thus obtained are the same as in Example 58.

INDUSTRIAL APPLICABILITY 1,2-Dicloroethane may be used as a solvent. Furthermore, 1,2-dichloroethane may be useful for the production of vinyl chloride serving as an important monomer in the manufacture of polymers.

We claim:

1. A method for preparing 1,2-dichloroethane by electrolysis of a 12–36% aqueous solution of hydrochloric acid at a temperature of from 45° to 70° C. simultaneously with admission of ethylene into the anodic space, which comprises, prior to electrolysis, an additive comprising a metal of the group of ion, or a compound of a metal of said group, or an alloy containing at least one metal of the group of iron, or any mixtures of said substances, is introduced into an aqueous solution of hydrochloric acid in such an amount that the concentration of ions of metals of the group of iron in the aqueous solution of hydrochloric acid is at least 0.006 g-ion per liter of said solution.

2. A method according to claim 1, wherein as the additive, use is made of nickel or cobalt or a compound of said metals, or an alloy based thereon, or any mixtures of said substances, or a mixture of at least one of said substances with at least one of the following substances: iron, an iron compound, an iron-based alloy, the additive being introduced into the aqueous solution of hydrochloric acid in such an amount that the concentration of ions of said metals is within the range of from 0.02 to 0.08 g-ion per liter of said solution.

3. A method according to claim 1, or 2 wherein as the additive, use is made of iron, or an iron compound, or an iron-based alloy, or mixtures of said substances, the additive being introduced into the aqueous solution of hydrochloric acid in such an amount that the concentration of iron ions be equal to 0.03–0.4 g-ion per liter of said solution.

4. A method according to claim 1 or 2 or 3, wherein the electrolysis is carried out in a membraneless electrolyzer at an anodic current density ranging from 0.4 to 1.3 $A/cm^2$.

5. A method according to claim 1, wherein the additive is a member selected from the group consisting of ferric chloride, siderite $FeCO_3$, ferrous hydroxide, ferric oxide, ferric sulphate, a mixture of metallic iron and ferric hydroxide, and mixtures of iron and Mn, chlorides of nickel and iron and metallic iron and ferric hydroxide.

* * * * *